US009882254B2

(12) United States Patent
Chiang et al.

(10) Patent No.: US 9,882,254 B2
(45) Date of Patent: Jan. 30, 2018

(54) MICROSTRIP LINE FILTER

(71) Applicant: Sercomm Corporation, Taipei (TW)

(72) Inventors: Meng-Chien Chiang, Taipei (TW); Chien-Ming Chen, Taipei (TW)

(73) Assignee: SERCOMM CORPORATION, Taipei (TW)

( * ) Notice: Subject to any disclaimer, the term of this patent is extended or adjusted under 35 U.S.C. 154(b) by 153 days.

(21) Appl. No.: 14/791,719

(22) Filed: Jul. 6, 2015

(65) Prior Publication Data

US 2016/0013533 A1 Jan. 14, 2016

(30) Foreign Application Priority Data

Jul. 10, 2014 (CN) ..... 2014 1 0326631
Apr. 14, 2015 (CN) ..... 2015 1 0175623

(51) Int. Cl.
*H01P 1/203* (2006.01)
*H01P 7/08* (2006.01)

(52) U.S. Cl.
CPC ..... *H01P 1/20372* (2013.01); *H01P 7/08* (2013.01); *H01P 7/082* (2013.01)

(58) Field of Classification Search
CPC ..... H01P 1/20372; H01P 7/08; H01P 7/088; H01P 7/082; H01P 7/084
USPC ..... 333/168, 175, 204, 238
See application file for complete search history.

(56) References Cited

U.S. PATENT DOCUMENTS 3,718,874 A * 2/1973 Cooper, Jr. ..... H03H 7/0161 333/204
2006/0145782 A1* 7/2006 Liu ..... H03H 7/463 333/132
2011/0273245 A1 11/2011 Pai et al.

FOREIGN PATENT DOCUMENTS

CN 101436696 A 5/2009
CN 102111114 A 6/2011
CN 102820503 A 12/2012
CN 103346369 A 10/2013
CN 103427139 A 12/2013

OTHER PUBLICATIONS

Xiao et al.; "Novel Compact Hairpin SIR Bandpass Filters with Defected Ground Structure"; Jul. 2007.*

* cited by examiner

*Primary Examiner* — Rakesh Patel
(74) *Attorney, Agent, or Firm* — McClure, Qualey & Rodack, LLP

(57) ABSTRACT

Disclosed herein is a microstrip line filter including a dielectric substrate, a first hairpin resonator, and a metal ground layer. The first hairpin resonator is disposed on a first layer of the dielectric substrate. The metal ground layer is disposed on a second layer of the dielectric substrate. The metal ground layer includes a first defected ground structure. The first defected ground structure includes a first defected area, a second defected area, and a third defected area. The projection of the first defected area on the first layer is located inside the hairpin structure of the first hairpin resonator. The projection of the second defected area on the first layer is located in a direction opposite to an opening direction of the first hairpin resonator. The third defected area connects the first defected area and the second defected area.

16 Claims, 8 Drawing Sheets

MICROSTRIP LINE FILTER

This application claims the benefits of People's Republic of China application Serial No. 201410326631.2, filed Jul. 10, 2014, and Serial No. 201510175623.7, filed Apr. 14, 2015, the subject matters of which are incorporated herein by reference.

BACKGROUND OF THE INVENTION

Field of the Invention

The invention relates in general to a microstrip line filter, and more particularly to a microstrip line filter having a defected ground structure (DGS).

Description of the Related Art

As technology advances, wireless communication technologies, such as Wi-Fi, ZigBee, and Bluetooth, have been widely used in people's everyday life. A filter is an important component in wireless communication products because the filter is capable of removing unwanted frequency components from signals, which improves signal quality of wireless communication products.

In response to a trend of small and lightweight communication products and the user's request for a higher communication quality, there is a need for reducing the area occupied by the filter, decreasing the manufacturing cost, and providing the filter with better frequency characteristics.

SUMMARY OF THE INVENTION

The invention is directed to a microstrip line filter having better frequency characteristics and requiring smaller circuit area.

According to one embodiment of the present invention, a microstrip line filter is disclosed. The microstrip line filter includes a dielectric substrate, a first hairpin resonator and a metal ground layer. The first hairpin resonator is disposed on a first layer of the dielectric substrate. The metal ground layer is disposed on a second layer of the dielectric substrate, and includes a first defected ground structure. The first defected ground structure includes a first defected area, a second defected area and a third defected area. The projection of the first defected area on the first layer is located inside the hairpin structure of the first hairpin resonator. The projection of the second defected area on the first layer is located in a direction opposite to an opening direction of the first hairpin resonator. The third defected area connects the first defected area and the second defected area.

The microstrip line filter provided in this disclosure achieves better frequency characteristics because the microstrip circuit on the printed circuit board is accompanied with a corresponding defected ground structure. Furthermore, because the defected ground structure may be aligned with the microstrip line circuit disposed on the printed circuit board, equivalent inductance can be increased and hence the same filtering function can be accomplished with a smaller circuit area.

The above and other aspects of the invention will become better understood with regard to the following detailed description of the preferred but non-limiting embodiment(s). The following description is made with reference to the accompanying drawings.

DETAILED DESCRIPTION OF THE INVENTION

A number of embodiments and accompanying drawings are disclosed below for elaborating the invention, not for limiting the scope of protection of the invention.

According to a conventional approach, a filter, such as a low-pass filter, a high-pass filter or a band-pass filter, is formed by lumped elements including resistors, capacitors and inductors. For a filter consisting of lumped elements, in order to achieve greater attenuation on the second harmonic and the third harmonic frequency components, more lumped elements are required. However, more lumped elements occupy a larger circuit area and increase manufacturing cost, which limits possible applications of the filter.

According to the embodiments of the invention, the filter may be formed by microstrip line circuits on a printed circuit board (PCB). The performance of the filter thus formed is better than that of the filter formed by lumped elements in particular regarding the high-frequency portion of the frequency response (the lumped elements generate a parasitic effect at high frequencies). Since the filter may be directly formed on a printed circuit board, there is no need to purchase additional elements and the manufacturing cost is effectively reduced.

In order to achieve better frequency characteristics, for example, better attenuation effect on signals at the stop-band, defected structures are created in the ground plane of a printed circuit board to form a specific pattern. For example, a defected ground structure is formed by removing a portion of the metal on the ground plane by an etching process. The defected ground structure can form equivalent inductors and capacitors, and thus change current distribution and achieve better filter frequency characteristics. Since the filter in this disclosure is formed by microstrip line circuits on PCB instead of lumped elements, the filter can be manufactured consistently and has little variation in frequency characteristics. Detailed descriptions of the embodiments of the invention are disclosed below.

Figure 1A:
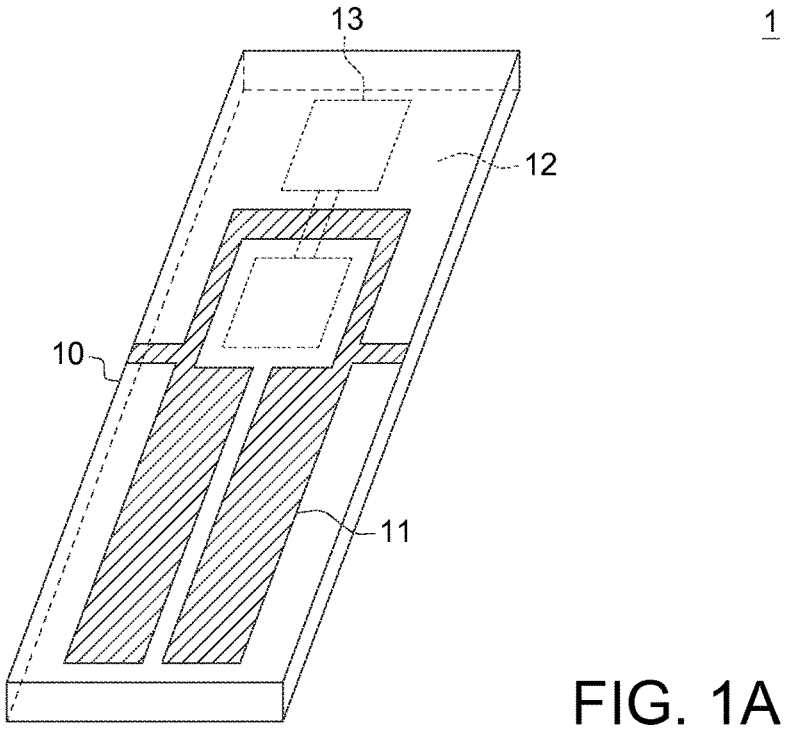
FIG. 1A shows a schematic diagram of a microstrip line filter according to the first embodiment of the invention.
Figure 1B:
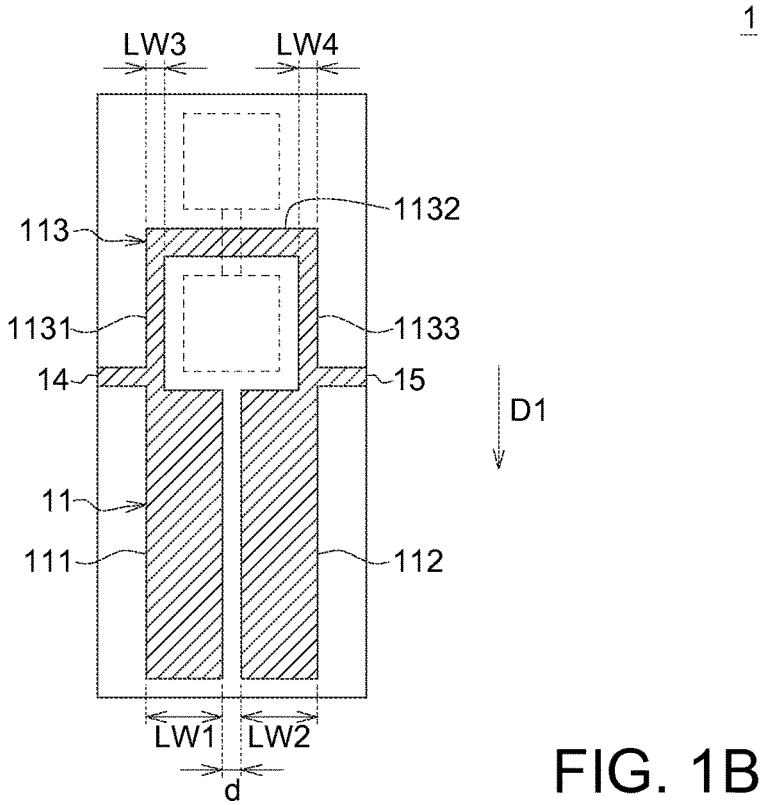
FIG. 1B shows a top view of the microstrip line filter according to the first embodiment of the invention.
Figure 1C:
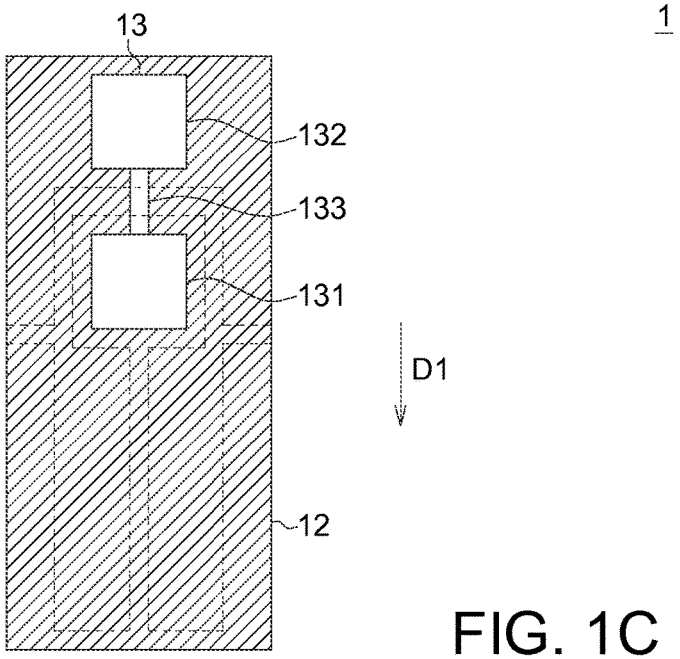
FIG. 1C shows a bottom view of the metal ground layer of the microstrip line filter according to the first embodiment of the invention.

FIG. 1A shows a schematic diagram of a microstrip line filter 1 according to the first embodiment of the invention. The microstrip line filter 1 includes a dielectric substrate 10, a first hairpin resonator 11 and a metal ground layer 12. To more clearly illustrate the first embodiment of the invention, FIGS. 1B and 1C are provided. FIG. 1B shows a top view of the microstrip line filter 1 according to the first embodiment of the invention. FIG. 1C shows a bottom view of the metal ground layer 12 of the microstrip line filter 1 according to the first embodiment of the invention.

The first hairpin resonator 11 is disposed on a first layer of the dielectric substrate 10, such as an upper surface of the dielectric substrate 10. The metal ground layer 12 is disposed on a second layer of the dielectric substrate 10. The metal ground layer 12 includes a first defected ground structure 13. The first defected ground structure 13 includes a first defected area 131, a second defected area 132 and a third defected area 133. The projection of the first defected area 131 on the first layer of the dielectric substrate 10 is located inside the hairpin structure of the first hairpin resonator 11. The projection of the second defected area 132 on the first layer of the dielectric substrate 10 is located in a direction opposite to an opening direction of the first hairpin resonator 11. The third defected area 133 connects the first defected area 131 and the second defected area 132. Detailed descriptions of each element are disclosed below.

Referring to FIG. 1B, the first hairpin resonator 11 includes a first metal strip 111, a second metal strip 112, and a U-shaped metal strip 113. The second metal strip 112 is parallel to and separated from the first metal strip 111 by a distance d. One end of the U-shaped metal strip 113 is connected to the first metal strip 111, and the other end of the U-shaped metal strip 113 is connected to the second metal strip 112. Therefore, the U-shaped metal strip 113 in conjunction with the first metal strip 111 and the second metal strip 112 forms a hairpin structure having an opening. As shown in FIG. 1B, the opening direction of the first hairpin resonator 11 is the direction D1.

The U-shaped metal strip 113 used in the present embodiment includes a first metal segment 1131, a second metal segment 1132 and a third metal segment 1133. The first metal segment 1131 is connected to the first metal strip 111. The second metal segment 1132 is perpendicular to the first metal segment 1131 and the third metal segment 1133. The third metal segment 1133 is connected to the second metal strip 112.

In the first hairpin resonator 11, both the first metal strip 111 and the first metal segment 1131 connected to the first metal strip 111 are rectangular; the line width of the first metal segment 1131 is not equivalent to that of the first metal strip 111. The line width LW3 of the first metal segment 1131 is smaller than the line width LW1 of the first metal strip 111. The third metal segment 1133 and the first metal segment 1131 have the same shape and the same size. The second metal strip 112 and the first metal strip 111 have the same shape and the same size (the first metal strip 111 and the second metal strip 112 form parallel coupled microstrip lines). Therefore, the first hairpin resonator 11 is a symmetric structure. The line width LW4 of the third metal segment 1133 is smaller than the line width LW2 of the second metal strip 112.

Descriptions of the first defected ground structure 13 of the present embodiment are made with reference to FIG. 10. FIG. 10 illustrates a lower surface of the dielectric substrate 10. The metal ground layer 12 is disposed on the lower surface of the dielectric substrate 10, shown as shaded area in FIG. 10. An etching process is performed on the metal ground layer 12 to remove a specific portion of metal to form the first defected ground structure 13. In FIG. 10, the first defected area 131, the second defected area 132 and the third defected area 133 are blank areas representing the areas where the metal has already been etched.

In the specification, the descriptions regarding the relative position between the first defected ground structure 13 and the first hairpin resonator 11 all refer to the projection of the first defected ground structure 13 on the upper surface of the dielectric substrate 10. To make the specification more concise, the term "projection" will not be repeatedly hereinafter. The first defected area 131 is located inside the first hairpin resonator 11. In the present embodiment, the first defected area 131 is surrounded by the U-shaped metal strip 113. The second defected area 132 is located in a direction opposite to the opening direction of the first hairpin resonator 11, that is, an opposite direction of direction D1, and located outside the hairpin structure of the first hairpin resonator 11. The third defected area 133, which connects the first defected area 131 and the second defected area 132, crosses the first hairpin resonator 11.

In the present embodiment, the first defected area 131 is rectangular. The second defected area 132 is rectangular, and has the same size as that of the first defected area 131. The third defected area 133 is rectangular. The third defected area 133 is across and perpendicular to the second metal segment 1132 of the U-shaped metal strip 113. Therefore, the first defected ground structure 13 has a dumbbell shape. One end of the dumbbell is located inside the hairpin structure of the first hairpin resonator 11, and the other end of the dumbbell is located outside the hairpin structure of the first hairpin resonator 11. The center portion of the dumbbell is across and perpendicular to the second metal segment 1132 and passes through the middle point of the second metal segment 1132.

The microstrip line filter 1 formed by the first hairpin resonator 11 and the first defected ground structure 13 is a low-pass filter capable of removing high-frequency components of the signal. The microstrip line filter 1 includes a signal feed point 14 and a signal output point 15. The signal feed point 14 is near the one end of the U-shaped metal strip 113 connected to the first metal strip 111. The signal output point 15 is near the other end of the U-shaped metal strip 113 connected to the second metal strip 112. The frequency response of the microstrip line filter 1 may be changed by adjusting the sizes of the first metal strip 111, the second metal strip 112, the U-shaped metal strip 113, the first defected area 131, the second defected area 132, and the third defected area 133. For example, parameters related to the frequency response may be changed, including cutoff frequency, return loss, insertion loss, and attenuation on the second and third harmonics.

The present embodiment discloses the shapes of the first hairpin resonator 11 and the first defected ground structure 13. However, a person skilled in the art would understand that the shapes of the first hairpin resonator 11 and the first defected ground structure 13 are not limited to the examples disclosed in the present embodiment, and may be designed according to the application and the desired frequency response. A number of other possible implementations are disclosed below. Any design in which the first defected area 131 is located inside the hairpin structure of the first hairpin resonator 11, the second defected area 132 is located in a direction opposite to the opening direction of the first hairpin resonator 11, and the third defected area 133 connects the first defected area 131 and the second defected area 132 is within the scope of the invention.

The first defected ground structure 13 may be S-shaped. For example, the first defected area 131 is rectangular, the second defected area 132 is C-shaped, one end of the second defected area 132 is connected to the third defected area 133, and the third defected area 133 is connected to a corner of the first defected area 131. The S-shaped defected ground structure is illustrated in FIG. 6B.

The microstrip line filter of the disclosed embodiments has a defected ground structure, which effectively reduces the size of the microstrip line circuit on the upper layer of the dielectric substrate and accordingly reduces the area required by the filter. Specifically, to achieve the same cutoff frequency, the U-shaped metal strip 113 used in a microstrip line filter having a defected ground structure can be shorter than that used in a microstrip line filter without a defected ground structure. In addition, the defected ground structure also improves the frequency characteristics of the microstrip line filter, such that the filter has a greater attenuation at the stop-band. Frequency response of a conventional first order filter has a slope of −6 dB per octave. If a larger attenuation rate is desired, the filter must be a higher order filter, which requires a larger circuit area. The microstrip line filter having a defected ground structure as disclosed herein requires a small circuit area and achieves good filter frequency characteristics.

The microstrip line filter 1 of the first embodiment includes a first hairpin resonator 11 and a first defected ground structure 13. To achieve better filter frequency response, one more stage of filter may be connected to the signal output point 15 of the first embodiment. Detailed descriptions of the second embodiment of the invention are disclosed below.

Figure 2:
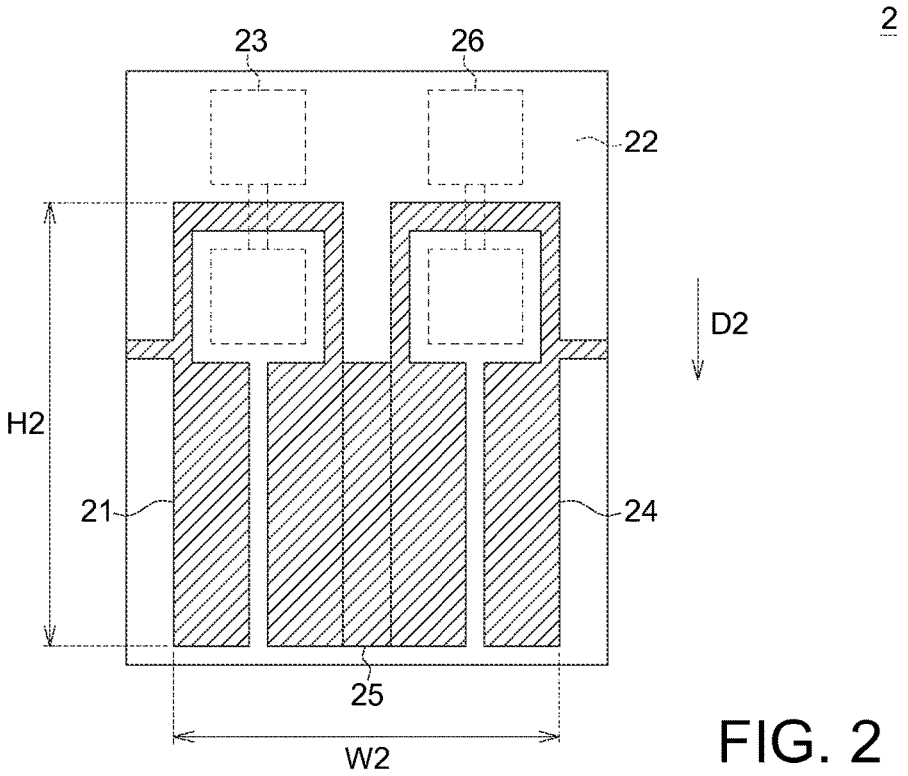
FIG. 2 shows a top view of a microstrip line filter according to the second embodiment of the invention.

FIG. 2 shows a top view of a microstrip line filter according to the second embodiment of the invention. Like the first embodiment, a metal ground layer 22 is disposed on a lower surface of the dielectric substrate, and the details are not repeated here. The microstrip line filter 2 of the present embodiment further includes a second hairpin resonator 24 and a connecting metal strip 25 in addition to the first hairpin resonator 21 and the first defected ground structure 23 that are already disclosed in the first embodiment. The opening direction of the second hairpin resonator 24 is the same as the opening direction of the first hairpin resonator 21, which is the direction D2 shown in FIG. 2. The connecting metal strip 25 connects the first hairpin resonator 21 and the second hairpin resonator 24. The metal ground layer 22 further includes a second defected ground structure 26.

In the embodiment illustrated in FIG. 2, two identical filters are connected in cascade. However, any person skilled in the art would understand that the two stages of filters may have the same or different structures. That is, the second hairpin resonator 24 and the first hairpin resonator 21 may have different shapes, and the second defected ground structure 26 and the first defected ground structure 23 also may have different shapes. Furthermore, the two stages of filters may have similar structures with different sizes. Any structures and sizes would do as long as the microstrip line filters connected in cascade can achieve the desired frequency response.

Figure 3:
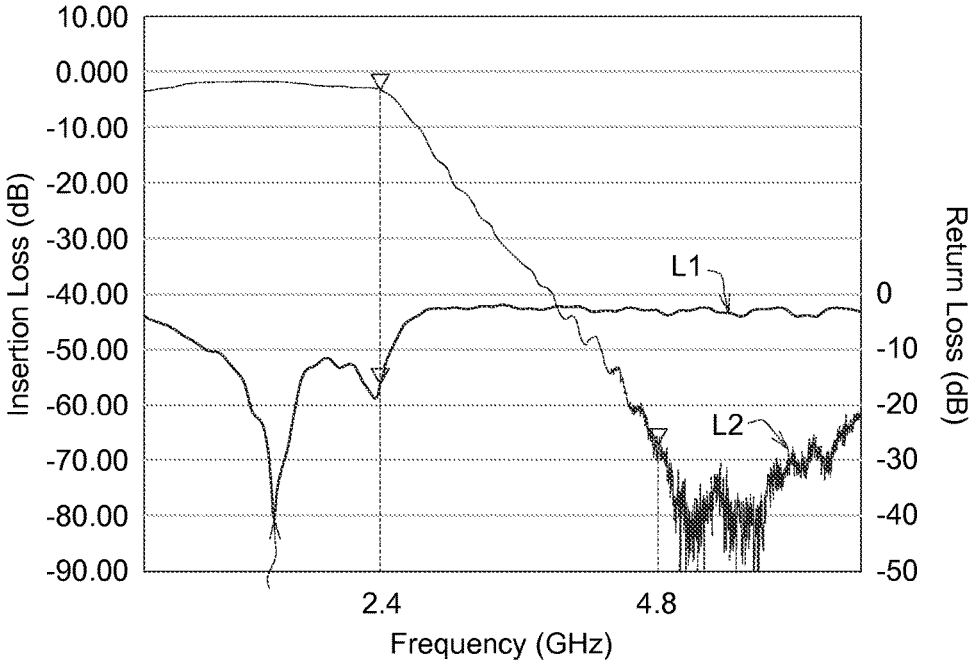
FIG. 3 shows a diagram of frequency response obtained from measurement according to the second embodiment of the invention.

FIG. 3 shows a diagram of frequency response obtained from measurement according to the second embodiment of the invention. The measurement is based on the microstrip line filter 2 with a width W2 of 6.6 mm and a height H2 of 6.9 mm, wherein the size is selected according to the frequency band requirement of the wireless communication product used in actual applications. In FIG. 3, curve L1 represents a return loss of the microstrip line filter 2, that is, the parameter S11. Normally, the return loss has a threshold value of −10 dB. As shown in FIG. 3, the microstrip line filter 2 has a good return loss when the frequency is around 2.4 GHz. Curve L2 represents an insertion loss of the microstrip line filter 2, that is, the parameter S21. Curve L2 shows that the microstrip line filter 2 is a low-pass filter, and the cutoff frequency is about 2.6 GHz. Therefore, the microstrip line filter 2 of the present embodiment can be used in wireless communication products having a frequency band of 2.4 GHz, such as the wireless communication products using Wi-Fi or ZigBee radios. The filter has an insertion loss of −1.3 dB at the frequency of 2.4 GHz. Note that the filter has an insertion loss of −68.25 dB at the frequency corresponding to the second harmonic (that is, 4.8 GHz). In comparison to the conventional filter, the microstrip line filter 2 greatly increases the amount of attenuation on the second harmonic.

The filter parameters may be adjusted according to the required specifications. For example, the design of the filter can be adjusted according to the insertion loss at frequency of 2.4 GHz, the insertion loss at frequency of the second harmonic, and the insertion loss at frequency of the third harmonic. Table 1 shows actually measured frequency response of the low-pass filter designed according to different needs.

TABLE 1

| Filter | S11 (dB) (2.4 GHz) | S21 (dB) (2.4 GHz) | S21 (dB) (4.8 GHz) | S21 (dB) (7.2 GHz) |
|---|---|---|---|---|
| Example 1 | −16.223 | −1.02 | −73.179 | −60.939 |
| Example 2 | −17.249 | −0.633 | −36.281 | −78.445 |

As shown in Table 1, the filter proposed in this disclosure has good attenuation on the second harmonic and the third harmonic. The return loss can also fulfill actual needs. No matter the filter is used in a transmitting end or in a receiving end of wireless signals, signal distortion and interference will be greatly reduced if the harmonic components can be attenuated by a large amount. For example, the transmitter can avoid transmitting the harmonics generated by internal circuits, and the receiver can filter out the harmonic components of the signal when receiving a signal.

Figure 4:
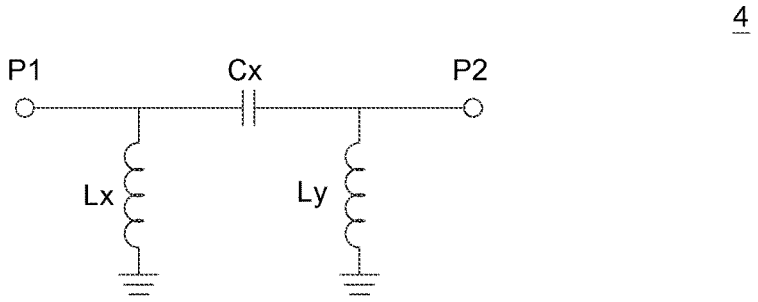
FIG. 4 shows a schematic illustrating an equivalent circuit of a high-pass filter in a microstrip line filter according to the third embodiment of the invention.

The microstrip line filter 2 of the second embodiment is a low-pass filter. To realize a band-pass filter, a high-pass filter may be cascade connected to the output end or the input end of the microstrip line filter 2. Therefore, the microstrip line filter of the third embodiment of the invention is realized by cascade connecting a high-pass filter 4 to the second hairpin resonator 24 of the second embodiment, wherein the high-pass filter 4 may be formed by lumped elements. FIG. 4 shows a schematic illustrating an equivalent circuit of a high-pass filter of a microstrip line filter according to the third embodiment of the invention. The high-pass filter 4 includes an input terminal P1, an output terminal P2, a capacitor Cx, and inductors Lx and Ly.

Figure 5:
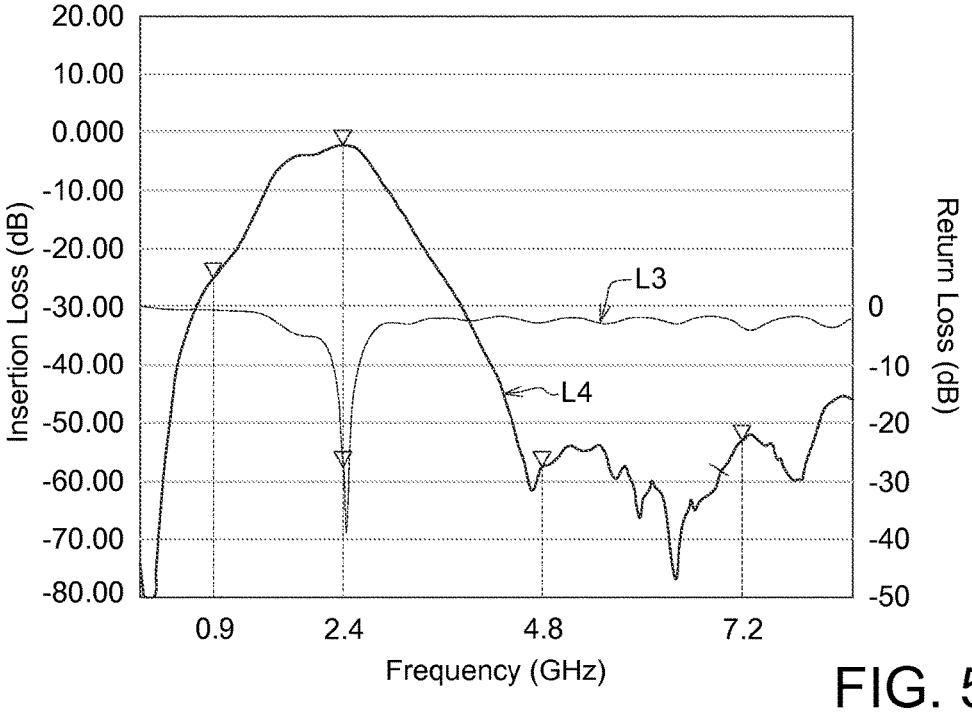
FIG. 5 shows a diagram of frequency response obtained from measurement according to the third embodiment of the invention.

FIG. 5 shows a diagram of frequency response obtained from measurement according to the third embodiment of the invention. Curve L3 represents a return loss of the microstrip line filter of the third embodiment. As shown in FIG. 5, the microstrip line filter still has a good return loss at frequency of 2.4 GHz. Curve L4 represents an insertion loss of the microstrip line filter of the third embodiment. It can be seen from curve L4 that the microstrip line filter is a band-pass filter, and only the frequency components near 2.4 GHz are allowed to pass. Therefore, the components of the signal with a lower frequency, such as 900 MHz, cannot pass through the band-pass filter (having an insertion loss of −25.13 dB). The filter has an insertion loss of −58.03 dB at the frequency of the second harmonic (4.8 GHz), and has an insertion loss of −53.00 dB at the frequency of the third harmonic (7.2 GHz). Therefore, the filter of the third embodiment can be used in wireless communication products having a frequency-band of 2.4 GHz, and has good attenuation on harmonic components.

Figure 6A:
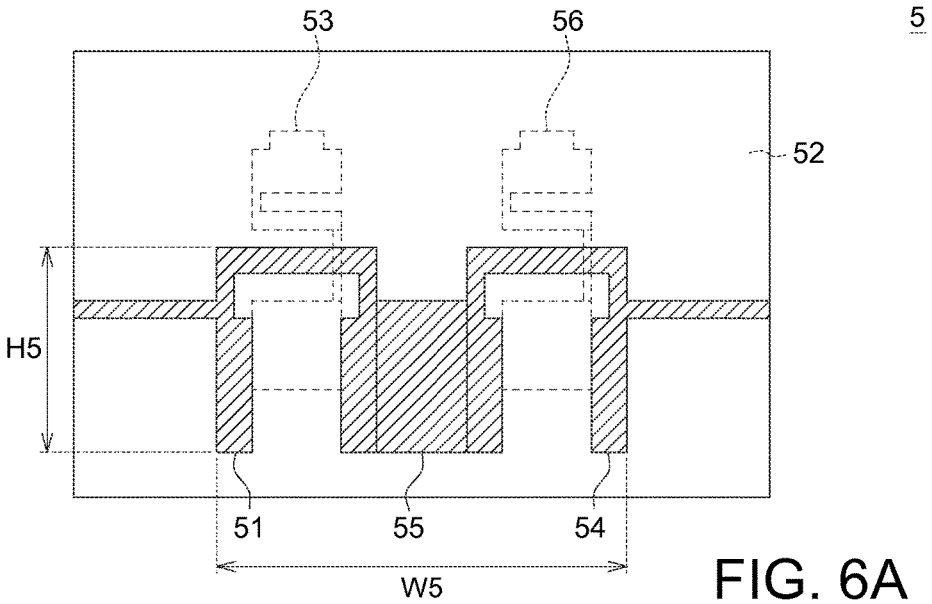
FIG. 6A shows a top view of a microstrip line filter according to the fourth embodiment of the invention.
Figure 6B:
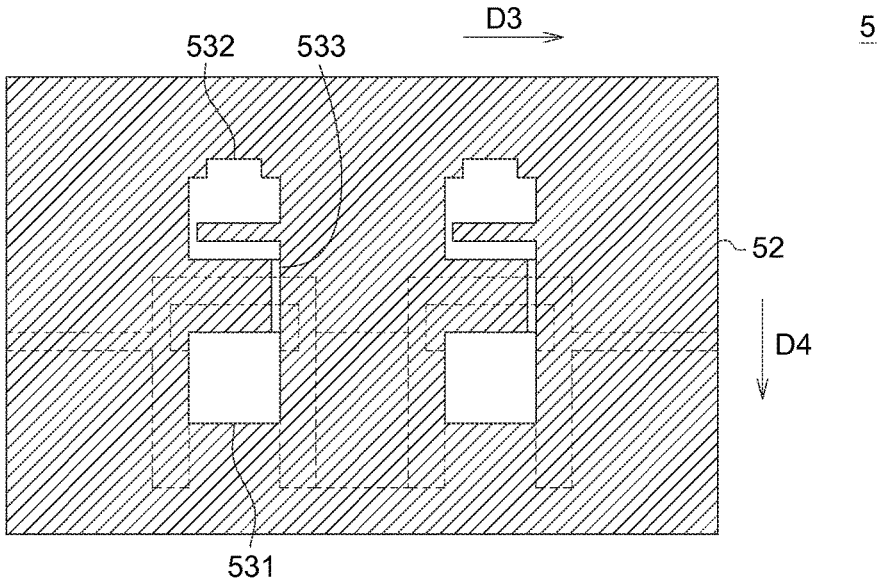
FIG. 6B shows a bottom view of a microstrip line filter according to the fourth embodiment of the invention.

FIG. 6A shows a top view of a microstrip line filter according to the fourth embodiment of the invention. FIG. 6B shows a bottom view of a microstrip line filter according to the fourth embodiment of the invention. Like previous embodiments, the filter of the fourth embodiment may also be realized by connecting two stages of identical filters in cascade, and thus the details are not repeated here. However, the defected ground structures used in the microstrip line filter 5 of the fourth embodiment may have different shapes from those in previous embodiments.

The microstrip line filter 5 includes a first hairpin resonator 51, a second hairpin resonator 54 and a connecting metal strip 55. The metal ground layer 52 includes a first defected ground structure 53 and a second defected ground structure 56. Since the second defected ground structure 56 and the first defected ground structure 53 have substantially the same structure, only the first defected ground structure 53 is described below.

Referring to FIG. 6B, the first defected ground structure 53 includes a first defected area 531, a second defected area 532 and a third defected area 533. In the present embodiment, the first defected area 531 is rectangular and located inside the hairpin structure of the first hairpin resonator 51. Note that the relative position of the first defected area 531 is different from that of the first defected area 131 shown in FIG. 10 where the first defected area 131 is completely surrounded by the U-shaped metal strip 113. The second defected area 532 is C-shaped, that is, the second defected area 532 has an opening, and the opening direction D3 of the C-shaped second defected area 532 is perpendicular to the opening direction D4 of the first hairpin resonator 51. The second defected area 532 is located in a direction opposite to the opening direction of the first hairpin resonator 51. The third defected area 533 is rectangular and connected to a corner of the rectangular first defected area 531. One end of the C-shaped second defected area 532 is connected to the third defected area 533. As a whole, the first defected ground structure 53 is S-shaped.

Figure 7A:
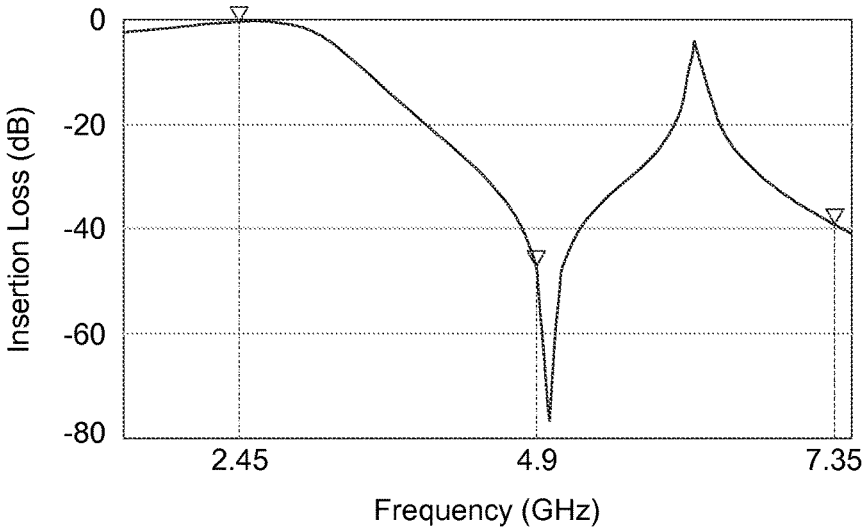
FIG. 7A and FIG. 7B show diagrams of frequency response obtained from measurement according to the fourth embodiment of the invention.
Figure 7B:
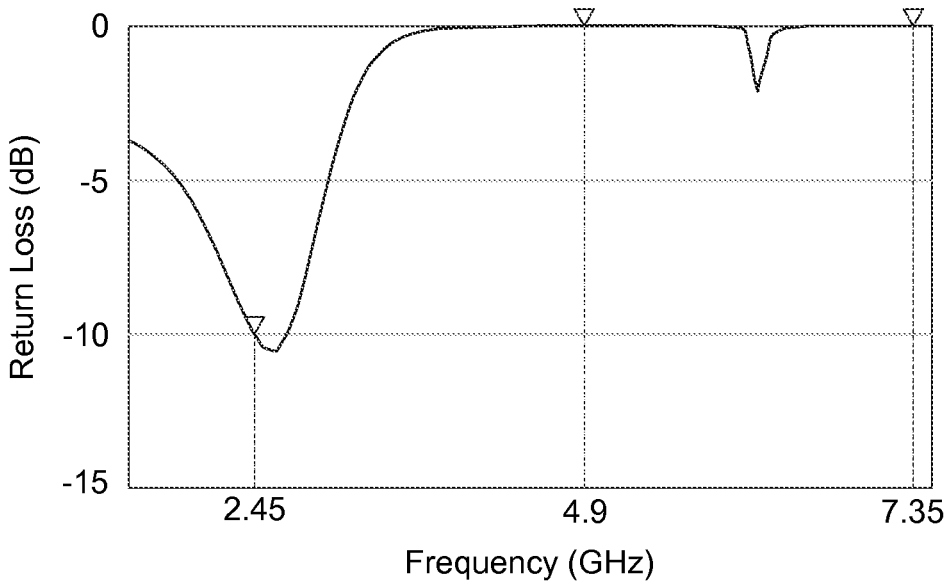

FIG. 7A and FIG. 7B show diagrams of frequency response obtained from measurement according to the fourth embodiment of the invention. The measurement is based on the microstrip line filter 5 with a width W5 of 11.6 mm and a height H5 of 5.8 mm. FIG. 7A shows the relation between insertion loss and frequency. The target frequency band of the microstrip line filter 5 is 2.45 GHz. As shown in FIG. 7A, the filter has an insertion loss of −0.45 dB at the frequency of 2.45 GHz, an insertion loss of −46.94 dB at the frequency of the second harmonic (4.9 GHz), and an insertion loss of −39.19 dB at frequency of the third harmonic (7.35 GHz). Therefore, the microstrip line filter 5 effectively attenuates harmonic components of the signal. FIG. 7B shows the relation between return loss and frequency. The filter has a return loss of −10.08 dB at the frequency of 2.45 GHz. Therefore, the microstrip line filter 5 can be used in wireless communication products operating at a frequency band of 2.45 GHz.

The microstrip line filters disclosed in the above embodiments are formed by microstrip line circuits on a printed circuit board. A specific pattern is formed on the metal ground layer of the printed circuit board to form the defected ground structure. The filter formed by the defected ground structure along with the microstrip line circuit on the upper surface of the printed circuit board achieves good frequency characteristics, particularly in attenuating harmonic components. Moreover, the filter may be formed directly on the printed circuit board, and hence additional lumped element or additional special manufacturing process on the printed circuit board is not required. The filter thus formed not only occupies a smaller circuit area but also reduces the manufacturing cost. Although the filters in the above embodiments have a pass band around 2.45 GHz, the filter proposed in this disclosure may be adapted to any frequency band, for example, a pass band around 5 GHz may also be applicable.

Figure 8A:
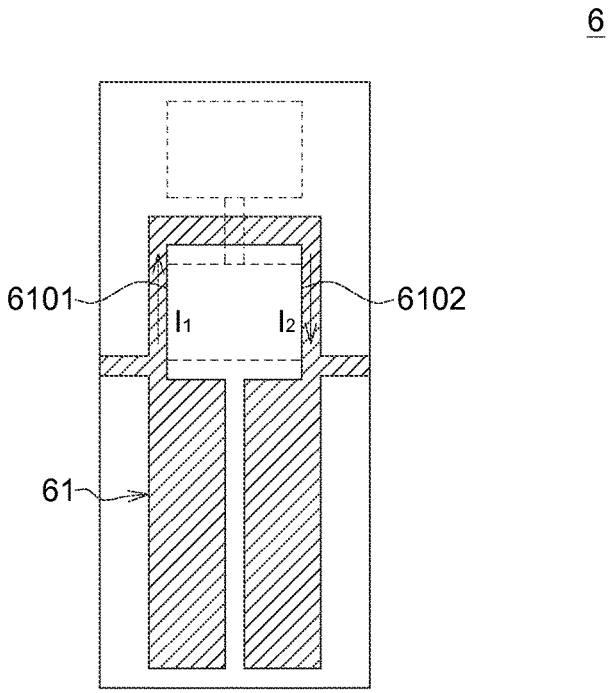
FIG. 8A shows a top view of a microstrip line filter according to the fifth embodiment of the invention.
Figure 8B:
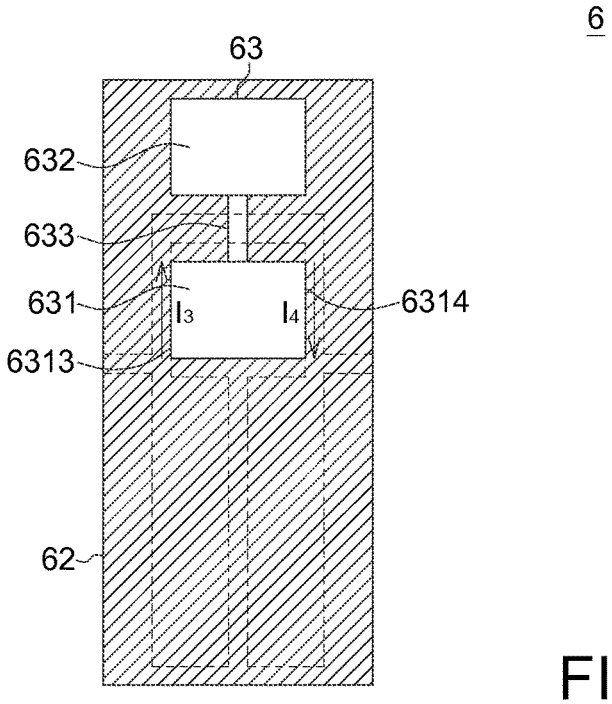
FIG. 8B shows a bottom view of a microstrip line filter according to the fifth embodiment of the invention.

FIG. 8A shows a top view of a microstrip line filter according to the fifth embodiment of the invention. FIG. 8B shows a bottom view of a microstrip line filter according to the fifth embodiment of the invention. The microstrip line filter 6 of the present embodiment is different from the microstrip line filter 1 of FIGS. 1A-1C in the relative relation between the hairpin resonator 61 and the defected ground structure 63. Like the first embodiment, the defected ground structure 63 includes a first defected area 631, a second defected area 632 and a third defected area 633. The first defected area 631 is located inside the hairpin structure of hairpin resonator 61. The second defected area 632 is located in a direction opposite to the opening direction of the hairpin resonator 61. The third defected area 633 connects the first defected area 631 and the second defected area 632.

As shown in FIG. 8A, the hairpin resonator 61 has a first edge 6101 and a second edge 6102 disposed opposite to each other inside the hairpin structure of the hairpin resonator 61. As shown in FIG. 8B, the first defected area 631 has at least one third edge 6313. Please refer to FIG. 8A and FIG. 8B, the projection of the third edge 6313 on the first layer of the dielectric substrate is aligned with the first edge 6101.

As shown in FIG. 8B, the first defected area 631 may further have at least one fourth edge 6314 parallel to the third edge 6313 and aligned with the second edge 6102. Note that the first defected area 631 may also be other shapes. In this exemplary embodiment the third edge 6313 is parallel to the fourth edge 6314.

The microstrip line filter 6 may be used as a radio frequency filter (RF filter) capable of transmitting alternating current signals. When a metal conductor transmits alternating current signals, the current density is largest near the surface of the conductor and decreases with greater depths in the conductor due to the skin effect. In FIG. 8A, the part of the metal conductor near the first edge 6101 and the second edge 6102 has a larger current density. In FIG. 8B, the part of the metal ground layer 62 near the third edge 6313 and the fourth edge 6314 has a larger current density.

For the alternating current signals, at a particular time instant, assume the current I1 on the first edge 6101 flows upwards, meanwhile, the current I2 on the second edge 6102 flows downwards, the current I3 of the metal ground layer 62 near the third edge 6313 flows upwards, and the current I4 of the metal ground layer 62 near the fourth edge 6314 flows downwards. Current generates an induced magnetic field. Therefore, when the current on the upper surface and the current on the lower surface flow in the same direction at the place where metal edges are aligned, for example, the current I1 and the current I3 flow in the same direction, the direction of the induced magnetic field generated by the current I1 will be the same as that generated by the current I3. The magnetic lines of force generated by the current I1 superimposed on the magnetic lines of force with substantially the same direction generated by the current I3 increases the mutual inductance.

Therefore, when the first edge 6101 is aligned with the third edge 6313, equivalent inductance will be increased. Likewise, when the second edge 6102 is aligned with the fourth edge 6314, equivalent inductance will be increased as well. Since the equivalent inductance is increased when the structure on the upper surface is aligned with the structure on the lower surface, the same inductance value can be achieved with a smaller circuit area. That is, the circuit area can be effectively reduced, and the same frequency response can still be achieved.

Figure 9A:
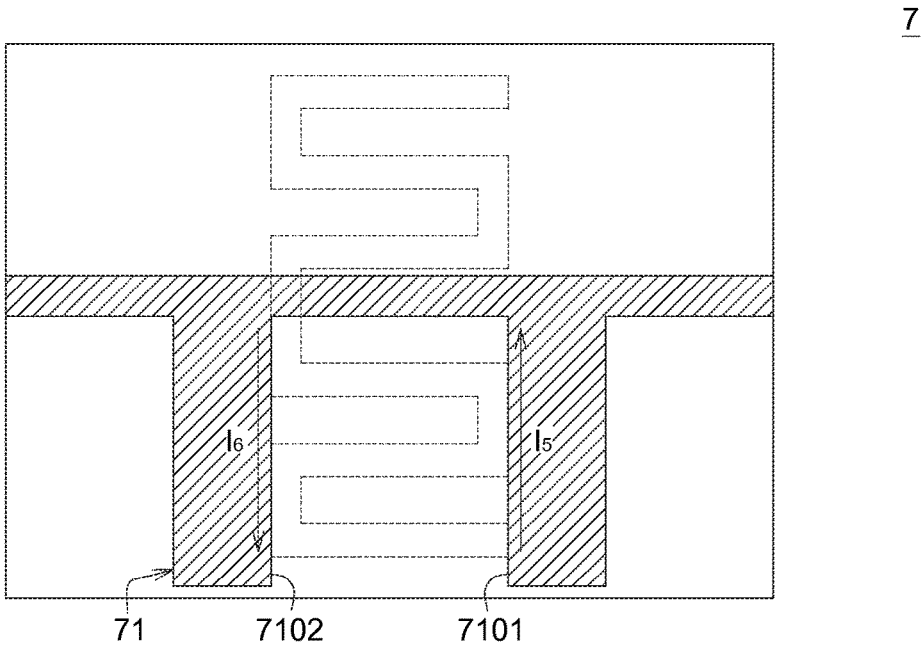
FIG. 9A shows a top view of a microstrip line filter according to the sixth embodiment of the invention.
Figure 9B:
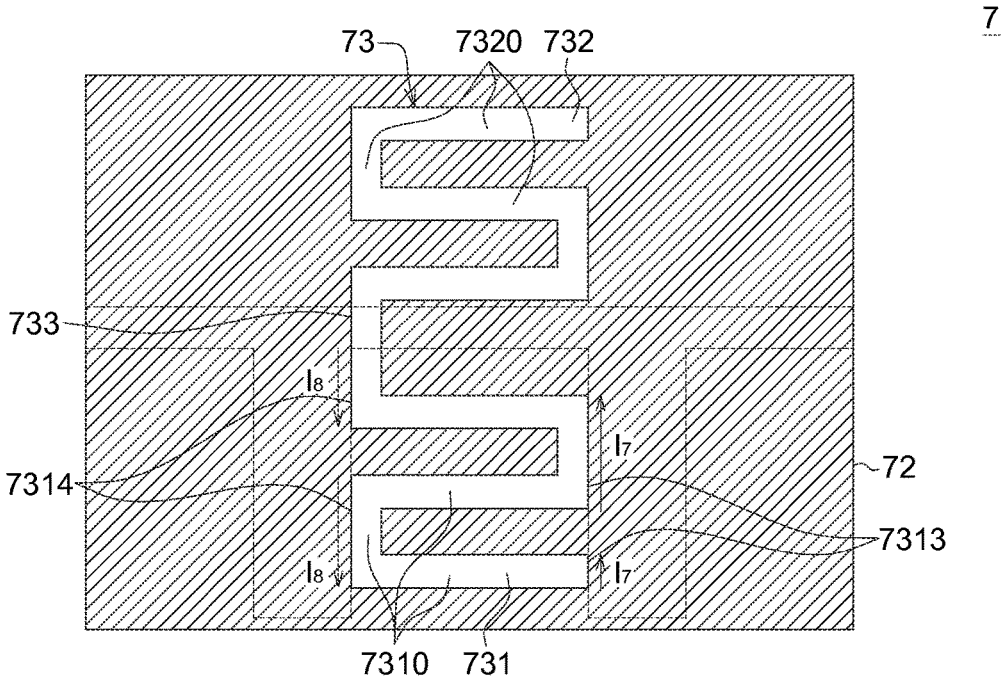
FIG. 9B shows a bottom view of a microstrip line filter according to the sixth embodiment of the invention.

FIG. 9A shows a top view of a microstrip line filter according to the sixth embodiment of the invention. FIG. 9B shows a bottom view of a microstrip line filter according to the sixth embodiment of the invention. The microstrip line filter 7 of the present embodiment differs from the microstrip line filter 6 in the shape of the defected ground structure 73. The first defected area 731 may include multiple first defected segments 7310 perpendicular to each other. The second defected area 732 may include multiple second defected segments 7320 perpendicular to each other. Both the first defected area 731 and the second defected area 732 may be S-shaped defected ground structures. However, the defected ground structure is not limited to a strict S-shaped structure and may also include more bending points. The microstrip line filter 7 has aligned structure between the upper surface and the lower surface.

As shown in FIG. 9A, the hairpin resonator 71 has a first edge 7101 and a second edge 7102 opposite to each other inside the hairpin structure of first hairpin resonator 71. As shown in FIG. 9B, the first defected area 731 has multiple third edges 7313 arranged in the same direction. In this example, multiple third edges 7313 are located at the right-hand side of the first defected area 731, and the first edge 7101 is aligned with multiple third edges 7313. The first defected area 731 may further have multiple fourth edges 7314 arranged in the same direction. In this example, multiple fourth edges 7314 are located at the left-hand side of the first defected area 731. Multiple third edges 7313 are parallel to multiple fourth edges 7314, and the second edge 7102 is aligned with multiple fourth edges 7314.

Like the previous embodiment, at a particular time instant, assume the current I5 on the first edge 7101 flows upwards, meanwhile, the current I6 on the second edge 7102 flows downwards, the current I7 on the metal ground layer 72 near multiple third edges 7313 flows upwards, and the current I8 of the metal ground layer 72 near multiple fourth edges 7314 flows downwards. Since the current on the upper surface and the current on the lower surface have the same direction at the place where metal edges are aligned, the equivalent inductance is increased. The present embodiment discloses a defected ground structure whose shape is different from that disclosed in previous embodiments. The filter of the present embodiment increases the equivalent inductance and thus requires smaller circuit area.

In the microstrip line filter 5 of FIG. 6A and FIG. 6B, the structure on the upper surface and the structure on the lower surface of the dielectric substrate may also be aligned. For example, an edge inside the hairpin structure of the first hairpin resonator 51 may be aligned with an edge of the first defected area 531. The inductance may also be increased in this example.

According to the microstrip line filters of the above embodiments, a defected ground structure is combined with a microstrip line circuit disposed on the upper surface of a printed circuit board, such that the filter achieves good frequency characteristics. Furthermore, because the defected ground structure is aligned with the microstrip line circuit disposed on the upper surface of the printed circuit board, the equivalent inductance can be increased, and hence the same filter performance can be accomplished with smaller circuit area.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A microstrip line filter, comprising:

a dielectric substrate;

a first hairpin resonator disposed on a first layer of the dielectric substrate, wherein the first hairpin resonator comprises a first metal strip, a second metal strip, and a U-shaped metal strip; and a metal ground layer disposed on a second layer of the dielectric substrate, wherein the metal ground layer comprises a first defected ground structure, the first defected ground structure comprising:

a first defected area, wherein a projection of the first defected area on the first layer is located inside a hairpin structure of the first hairpin resonator;

a second defected area, wherein a projection of the second defected area on the first layer is located in a first direction opposite to an opening direction of the first hairpin resonator; and a third defected area connecting the first defected area and the second defected area, the third defected area having a length along a second direction perpendicular to the first direction, wherein the length is smaller than a maximum length of the first defected area along the second direction;

wherein the U-shaped metal strip comprises a first metal segment, a second metal segment, and a third metal segment, the second segment connects the first metal segment and the third metal segment, and a projection of the third defected area on the first layer is perpendicular to the second metal segment of the U-shaped metal strip.

2. The microstrip line filter according to claim 1, wherein the first defected area is rectangular, the second defected area is rectangular, and the second defected area and the first defected area have the same size.

3. The microstrip line filter according to claim 1, wherein the first defected area is rectangular, the second defected area is C-shaped, one end of the second defected area is connected to the third defected area, and the third defected area is connected to a corner of the first defected area.

4. The microstrip line filter according to claim 1, wherein the second metal strip is parallel to the first metal strip, one end of the U-shaped metal strip is connected to the first metal strip, and the other end of the U-shaped metal strip is connected to the second metal strip.

5. The microstrip line filter according to claim 4, wherein the first metal segment is connected to the first metal strip, the second metal segment is perpendicular to the first metal segment, and the third metal segment is perpendicular to the second metal segment and connected to the second metal strip;

wherein the third defected area is rectangular.

6. The microstrip line filter according to claim 4, wherein the first metal segment is connected to the first metal strip;

the second metal segment is perpendicular to the first metal segment; and the third metal segment is perpendicular to the second metal segment and connected to the second metal strip;

wherein the first metal strip is rectangular, the first metal segment of the U-shaped metal strip is rectangular, a line width of the first metal segment is smaller than a line width of the first metal strip, the third metal segment and the first metal segment have the same shape and the same size, and the second metal strip and the first metal strip have the same shape and the same size.

7. The microstrip line filter according to claim 4, further comprising a signal feed point near the one end of the U-shaped metal strip connected to the first metal strip.

8. The microstrip line filter according to claim 1, further comprising:

a second hairpin resonator, wherein an opening direction of the second hairpin resonator is the same as the opening direction of the first hairpin resonator; and a connecting metal strip connecting the first hairpin resonator and the second hairpin resonator;

wherein the metal ground layer further comprises a second defected ground structure whose projection on the first layer overlaps the second hairpin resonator.

9. The microstrip line filter according to claim 8, wherein the second hairpin resonator and the first hairpin resonator have the same shape and the same size, the second defected ground structure and the first defected ground structure have the same shape and the same size, a relative position between the second defected ground structure and the second hairpin resonator is the same as a relative position between the first defected ground structure and the first hairpin resonator.

10. The microstrip line filter according to claim 8, further comprising a high-pass filter connected to the second hairpin resonator.

11. The microstrip line filter according to claim 1, wherein the first hairpin resonator has a first edge and a second edge opposite to each other inside the hairpin structure of the first hairpin resonator, and the first defected area has at least one third edge aligned with the first edge.

12. The microstrip line filter according to claim 11, wherein the first defected area further has at least one fourth edge parallel to the at least one third edge and aligned with the second edge.

13. The microstrip line filter according to claim 11, wherein the first defected area comprises a plurality of first defected segments perpendicular to each other.

14. The microstrip line filter according to claim 11, wherein the second defected area comprises a plurality of second defected segments perpendicular to each other.

15. A microstrip line filter, comprising:

a dielectric substrate;

a first hairpin resonator disposed on a first layer of the dielectric substrate, wherein the first hairpin resonator comprises a first metal strip, a second metal strip, and a U-shaped metal strip; and a metal ground layer disposed on a second layer of the dielectric substrate, wherein the metal ground layer comprises a first defected ground structure, the first defected ground structure comprising:

a first defected area, wherein a projection of the first defected area on the first layer is located inside a hairpin structure of the first hairpin resonator;

a second defected area, wherein a projection of the second defected area on the first layer is located in a direction opposite to an opening direction of the first hairpin resonator; and a third defected area connecting the first defected area and the second defected area;

wherein the U-shaped metal strip comprises a first metal segment, a second metal segment, and a third metal segment, the second segment connects the first metal segment and the third metal segment, and a projection of the third defected area on the first layer is perpendicular to the second metal segment of the U-shaped metal strip, and wherein the first defected area is rectangular, the second defected area is rectangular, and the second defected area and the first defected area have the same size.

16. A microstrip line filter, comprising:

a dielectric substrate;

a first hairpin resonator disposed on a first layer of the dielectric substrate, wherein the first hairpin resonator comprises a first metal strip, a second metal strip, and a U-shaped metal strip; and a metal ground layer disposed on a second layer of the dielectric substrate, wherein the metal ground layer comprises a first defected ground structure, the first defected ground structure comprising:

a first defected area, wherein a projection of the first defected area on the first layer is located inside a hairpin structure of the first hairpin resonator;

a second defected area, wherein a projection of the second defected area on the first layer is located in a direction opposite to an opening direction of the first hairpin resonator; and a third defected area connecting the first defected area and the second defected area;

wherein the U-shaped metal strip comprises a first metal segment, a second metal segment, and a third metal segment, the second segment connects the first metal segment and the third metal segment, and a projection of the third defected area on the first layer is perpendicular to the second metal segment of the U-shaped metal strip, and wherein the first defected area is rectangular, the second defected area is C-shaped, one end of the second defected area is connected to the third defected area, and the third defected area is connected to a corner of the first defected area.

* * * * *